US007913637B2

(12) United States Patent
Roehm, II et al.

(10) Patent No.: US 7,913,637 B2
(45) Date of Patent: Mar. 29, 2011

(54) MARINE SEATING SYSTEM AND APPARATUS

(75) Inventors: Robert E. Roehm, II, Markle, IN (US); Clifford M. Roehm, Ossian, IN (US)

(73) Assignee: Roehm Marine, LLC, Fort Wayne, IN (US)

( * ) Notice: Subject to any disclaimer, the term of this patent is extended or adjusted under 35 U.S.C. 154(b) by 557 days.

(21) Appl. No.: 12/018,866

(22) Filed: Jan. 24, 2008

(65) Prior Publication Data

US 2008/0178789 A1 Jul. 31, 2008

Related U.S. Application Data

(60) Provisional application No. 60/886,731, filed on Jan. 26, 2007.

(51) Int. Cl.
*B63B 17/00* (2006.01)

(52) U.S. Cl. ..... 114/363; 297/452.56

(58) Field of Classification Search ..... 114/363; 297/440.14, 452.56, 452.63
See application file for complete search history.

(56) References Cited

U.S. PATENT DOCUMENTS

| | | | | |
|---|---|---|---|---|
| 1,901,638 | A | 3/1933 | Ernest | |
| 3,107,944 | A | 10/1963 | Baermann | |
| 3,700,282 | A | 10/1972 | Rowland | |
| 5,439,271 | A * | 8/1995 | Ryan | 297/452.56 |
| 5,441,331 | A | 8/1995 | Vento | |
| 6,375,269 | B1 * | 4/2002 | Maeda et al. | 297/452.56 |
| 6,561,580 | B1 * | 5/2003 | Bergey | 297/216.1 |
| 6,733,084 | B2 | 5/2004 | Butler | |
| 6,783,182 | B1 | 8/2004 | Gallagher | |

* cited by examiner

*Primary Examiner* — Ed Swinehart
(74) *Attorney, Agent, or Firm* — Baker & Daniels LLP

(57) ABSTRACT

A boat comprising an assembled modular seat formed from two individual, modular seating components. Each seating component includes a base and a seating frame secured thereto. The seating frame further includes a front wall, a back wall, and a connecting structure extending therebetween. The connecting structure forms a void or depression extending substantially entirely between the front wall and the back wall of the seating frame. Extending from the front wall to the back wall and across the depression formed by the connecting structure is a layer of tightly stretched, resiliently extensible fabric support material. The support material, which may be attached directly to the seating frame, can then be covered by cushioning material and/or a final covering, such as foam and/or vinyl, respectively, to form the final seating surface.

19 Claims, 6 Drawing Sheets

MARINE SEATING SYSTEM AND APPARATUS

BACKGROUND OF THE INVENTION

1. Field of the Invention

The present invention relates to seating, and particularly seating for use in marine applications.

2. Description of the Related Art

Seating used in marine applications may be subjected to conditions substantially different from seating used in traditional applications. As a result, different considerations must be taken into account when creating marine seating. For example, unlike seating for a home or office, seating used in a marine application, such as on a pontoon boat, often encounters substantial amounts of water and, as a result, is made to withstand the same. Additionally, to provide flexibility to the manufacturer, such as a manufacturer of boats, marine seating may be designed to be modular.

Modular marine seating consists of various, individual components, such as sections of a bench seat, which can be arranged according to each manufacturer's specifications. For example, a marine bench seat may be formed from two, individual components which can be joined together on the deck of a pontoon boat. Each of the individual, modular components includes a seating frame upon which the seating surface is formed. The seating frame is rectangular and has four walls of equal height, e.g., a front wall, a back wall, and two connecting side walls. Cushioning material, such as foam, is then placed atop or within the walls of the seating frame to form the seating surface.

When two individual seating components are joined together to form a bench seat, the end walls of the seating frames of the individual seating components are connected together. Due to the height of the end walls being equal to the height of the front and back walls of the seating frame or otherwise protruding upwardly, the end walls form a ridge at the junction between the individual seating components. This ridge is substantial enough to be noticeable to a user seated on or near the junction of the individual seating components. Additionally, if a user moves along the bench seat, i.e., slides down the bench seat, and has to cross between the individual seating components, the user must cross over the ridge formed by the end walls of the seating frame, which may cause discomfort to the user.

SUMMARY OF THE INVENTION

The present invention relates to seating for use in marine applications. In one exemplary embodiment, an assembled modular seat is formed from two individual, modular seating components. Each seating component includes a base and a seating frame secured thereto. The seating frame further includes a front support structure, a back support structure, and a connecting structure extending therebetween. The connecting structure has a height that is less than the height of the front and back support structures. As a result, a void or depression is formed by the connecting structure which preferably extends substantially entirely between the front support structure and the back support structure of the seating frame. Extending from the front support structure to the back support structure and across the depression formed by the connecting structure is a resiliently extensible support material. In one exemplary embodiment, the support material is formed as a woven fabric and is tightly stretched between the front support structure and the back support structure of the seating frame. The support material may be formed from a polymer, such as polyester. The support material, which may be attached directly to the seating frame, can then be covered by cushioning material and/or a final covering, such as foam and/or vinyl, respectively, to form the final seating surface.

Advantageously, by creating a depression between the front support structure and the back support structure of the seating frame, i.e., forming the connecting structure with a height that is less at at least one point than the height of the front and back support structures of the seating frame, the ridge created when the modular seating components of the prior art are joined to form a completed seat is eliminated. Thus, a person seated on or near the junction formed between modular seating components of the present invention will experience substantially the same seating comfort as a person seated at a location spaced away from the junction.

Additionally, by utilizing the connecting structure of the present invention, the tightly stretched fabric support material extending between the front support structure and back support structure of the seating frame can deflect into the depression formed by the connecting structure in response to the weight of a user seated thereon. As a result, the stretched fabric provides a resilient spring-like support for the cushion and a person seated upon the seating surface will not contact the rigid connecting structure of the seating frame, which provides added comfort. Moreover, the resilient support material enables the use of a thinner foam layer so that there is less tendency for the cushioning material and/or the covering of the modular seating component to tighten around a user as the cushioning material and/or covering is extended. Such tightening of the cushioning material and/or covering can cause a mild pinching sensation, which is substantially eliminated with the design of the present invention.

In one exemplary embodiment, the seating frame and the base of the modular seating component of the present invention are secured to one another by an actuation mechanism. The actuation mechanism allows for the seating frame to be rotated away from the base to expose a cavity formed therein. This cavity can be used as a storage area to store items, such as life jackets, on a pontoon boat or other type of boat. In one exemplary embodiment, the actuation mechanism is connected to the base at a first rotational point and is connected to the seating frame at a second rotational point.

In one form thereof, the present invention provides a modular seat including a plurality of modular seating components each including a seating frame having a front support structure, a back support structure, and a connecting structure extending therebetween, the connection structure forming a depression extending substantially entirely from the front support structure to the back support structure, the plurality of modular seating components further including a stretched resiliently extensible fabric support material secured to and extending substantially entirely from the front support structure of the seating frame to the back support structure of the seating frame, the support material extending across the depression of the connecting structure to form a substantially planar unsupported surface spaced apart from the connecting structure, at least one of the plurality of modular seating components secured to another of the plurality of modular seating components in adjacent opposing relationship to form a junction therebetween.

In another form thereof, the present invention provides a vessel including a boat including a deck, a modular seating component positioned on the deck, the modular seating component including a base and a seating frame positioned on the base, the seating frame including a front support structure having a first length, a back support structure having a second length, and a connecting structure extending between the front support structure and the back support structure, the connecting structure forming a depression extending substantially entirely between the front support structure and the back support structure, the modular seating component further including a stretched resiliently extensible fabric support material secured to the front support structure and the back support structure, the support material extending across the depression to form a substantially planar unsupported surface spaced apart from the connecting structure and extending substantially entirely from the front support structure along the first length to the back support structure along the second length.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention any manner.

DETAILED DESCRIPTION

Figure 1:
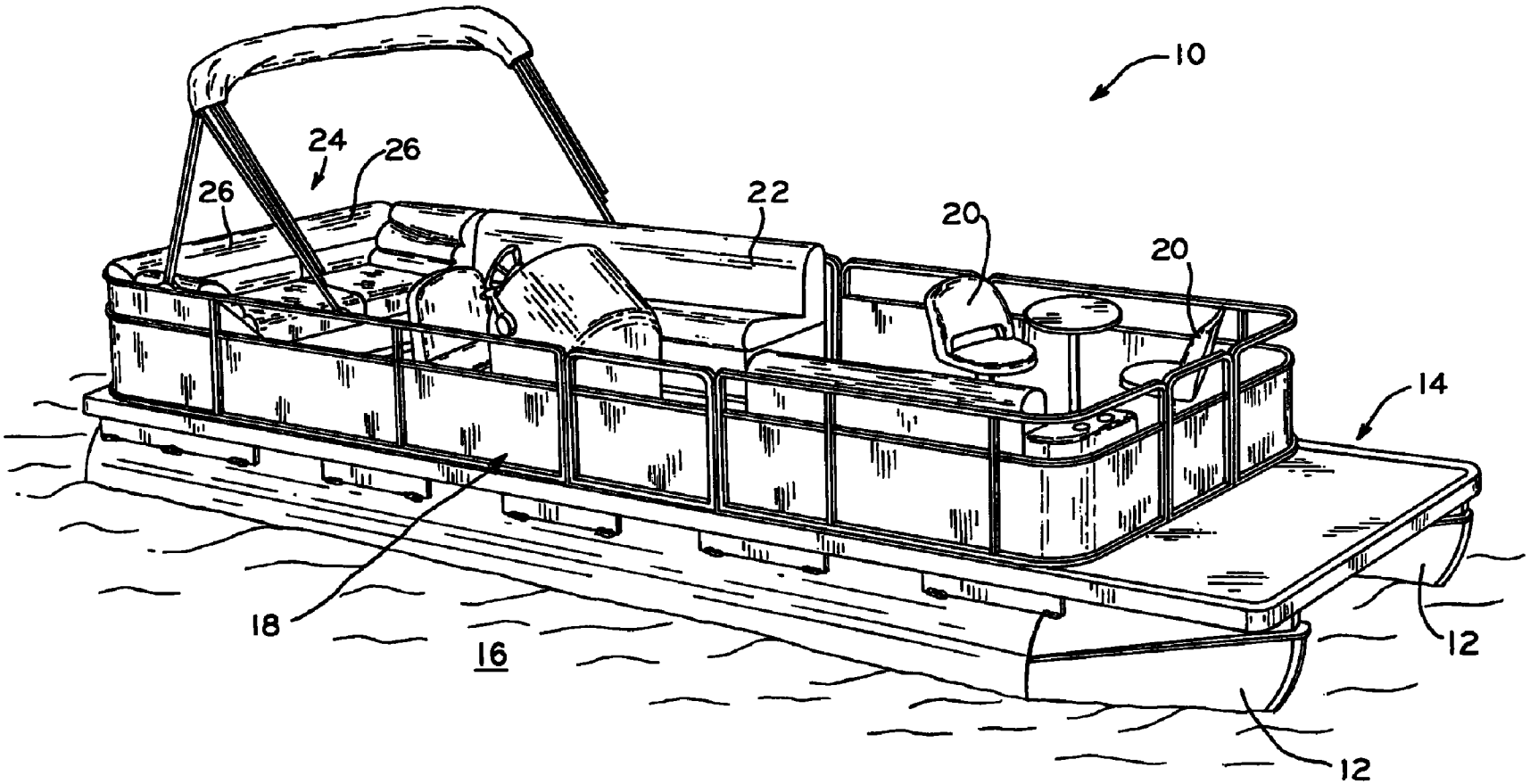
FIG. 1 is perspective view of a pontoon boat having a deck and an assembled modular seat according to an embodiment of the present invention positioned on the deck.

FIG. 1 depicts pontoon boat 10 having floats 12 and deck 14. While boat 10 is described and depicted herein as a pontoon boat, boat 10 may be any type of boat, such as a deck boat. Deck 14 of pontoon boat 10 is positioned upon floats 12, which provide sufficient buoyancy to keep deck 14 above water 16. Substantially enclosing a portion of deck 14 is railing 18. Positioned within railing 18 are a variety of seating options for passengers aboard pontoon boat 10. Specifically, chairs 20, seat 22, and assembled modular seat 24 are all positioned within railing 18 on deck 14. Due to varying consumer taste, as well as manufacturer preference, the arrangement of the seating on deck 14 may be varied. Thus, chairs 20, seat 22, and assembled modular seat 24 of FIG. 1 may be arranged in any manner or, alternatively, may be interchanged with other similar seating components.

Figure 2:
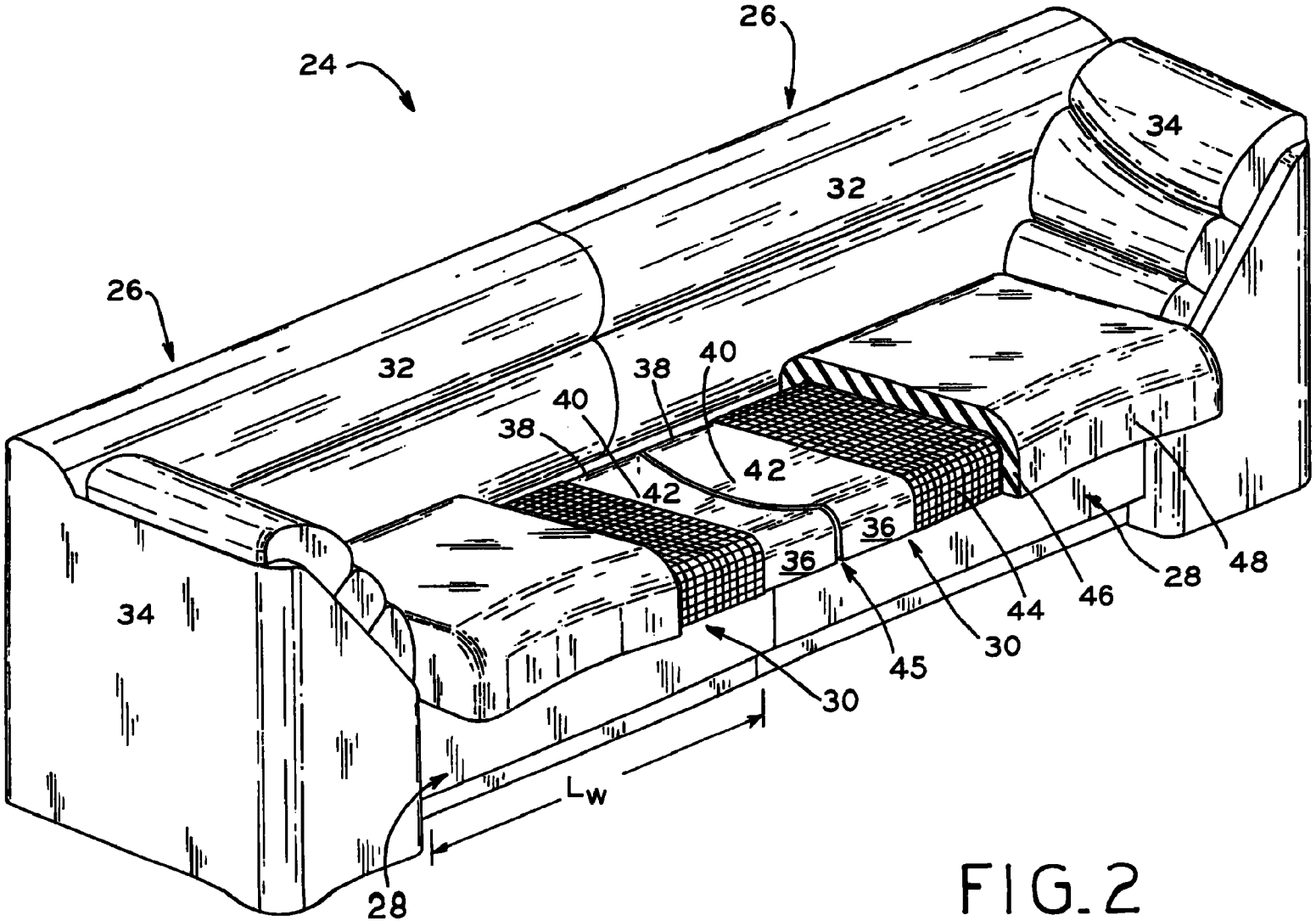
FIG. 2 is a partially segmented cross sectional view of the assembled seat of FIG. 1.

Referring to FIG. 2, modular seat 24 is formed from individual, modular seating components 26, which are positioned adjacent to and opposing one another to form junction 45 therebetween. Once positioned in adjacent, opposing relationship, modular seating components 26 are secured to one another to form modular seat 24. The securement of modular seating components 26 together to form modular seat 24 may be achieved using any known fastening system. As shown in FIG. 2, each modular seating component 26 includes base 28, seating frame 30, back 32, and side unit 34. As depicted and described herein, side units 34 are arranged with bases 28, seating frames 30 (FIGS. 5-7), and backs 32 to form benches or chaises, i.e., units having a long seat that supports multiple occupants or an outstretched person. While described and depicted herein as forming chaises, side units 34 may form any desired seating structure.

Figure 6:
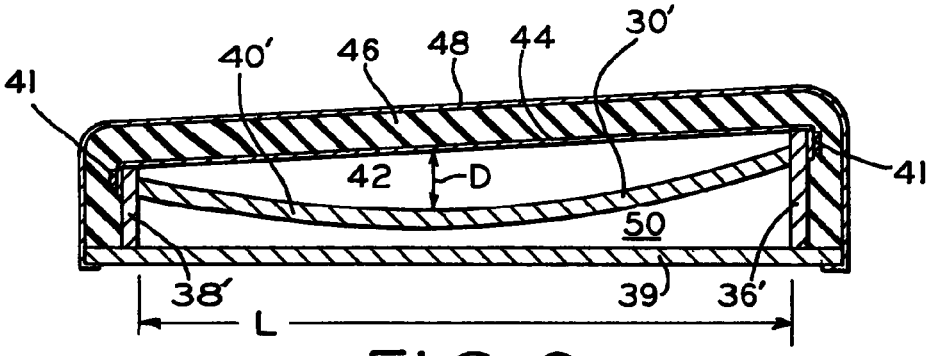
FIG. 6 is a perspective view of a seating frame and support material according to another embodiment of the present invention.
Figure 7:
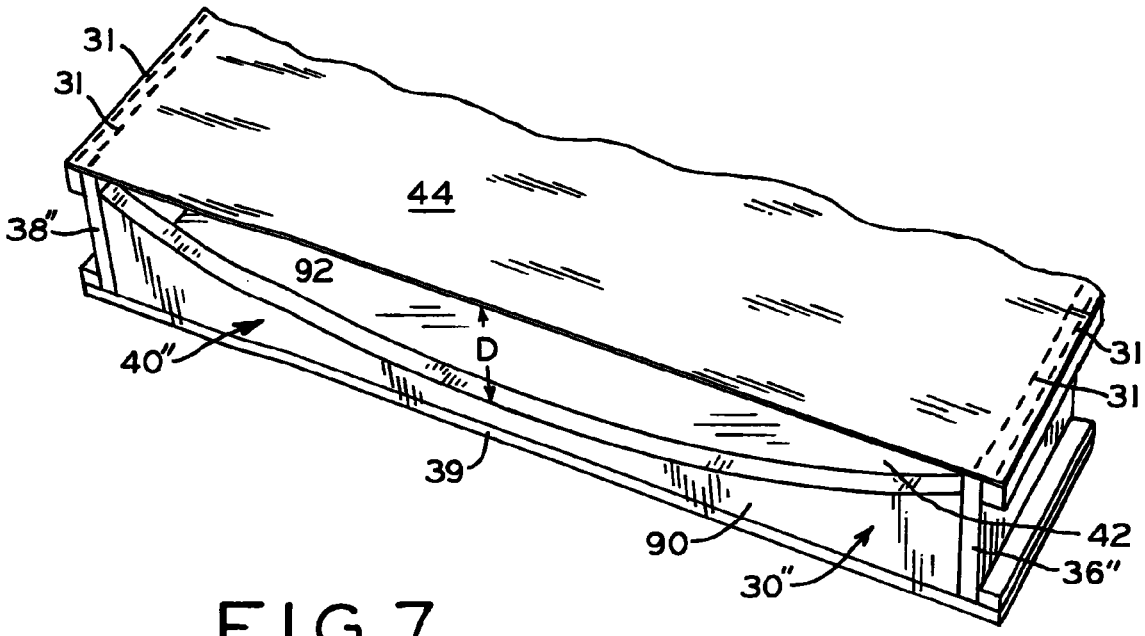
FIG. 7 is a cross-sectional view of the seating frame and related components of the assembled seat of FIG. 8 taken along line 7-7 of FIG. 8.

As shown in FIG. 2, each seating frame 30 is positioned atop base 28 of modular seating component 26. Seating frame 30 includes front supporting structure such as wall 36 and back supporting structure such as wall 38, both of which are positioned on support 39 (FIG. 7). In other exemplary embodiments, support 39 is not present and seating frame 30 is positioned directly atop or, alternatively, incorporated into base 28. Front wall 36 is spaced from and connected to back wall 38 via connecting structure 40. As described in detail below, connecting structure 40 forms a void or depression 42 extending substantially entirely between front wall 36 and back wall 38. Secured to and extending from front wall 36 to back wall 38 is resiliently extensible fabric support material 44, which is stretched tight to form a substantially planar unsupported surface between front wall 36 and back wall 38. In one exemplary embodiment, support material 44 is secured to front wall 36 of seating frame 30 via staples 31 (FIG. 7). Alternatively, support material 44 may be secured to front wall 36 in any known manner, including the use of adhesives or other suitable fasteners, such as screws 41 (FIG. 6).

Support material 44 may be formed from any resiliently extensible material capable of supporting the weight of a user thereon. In the preferred embodiment, support material 44 is a woven polyester fabric. For example, support material 44 may be Ultra-Flex™ Sheet Webbing manufactured by Ultraflex™, a subsidiary of Hickory Springs Manufacturing Company of Highpoint, N.C. To complete the seating surface of modular seating component 26, cushioning material 46, such as foam, is positioned on fabric support material 44. Covering 48, which, in one embodiment is a layer of vinyl, is then wrapped over cushioning material 46, fabric 44, and seating frame 30, to form the ultimate seating surface.

Figures 3, 4:
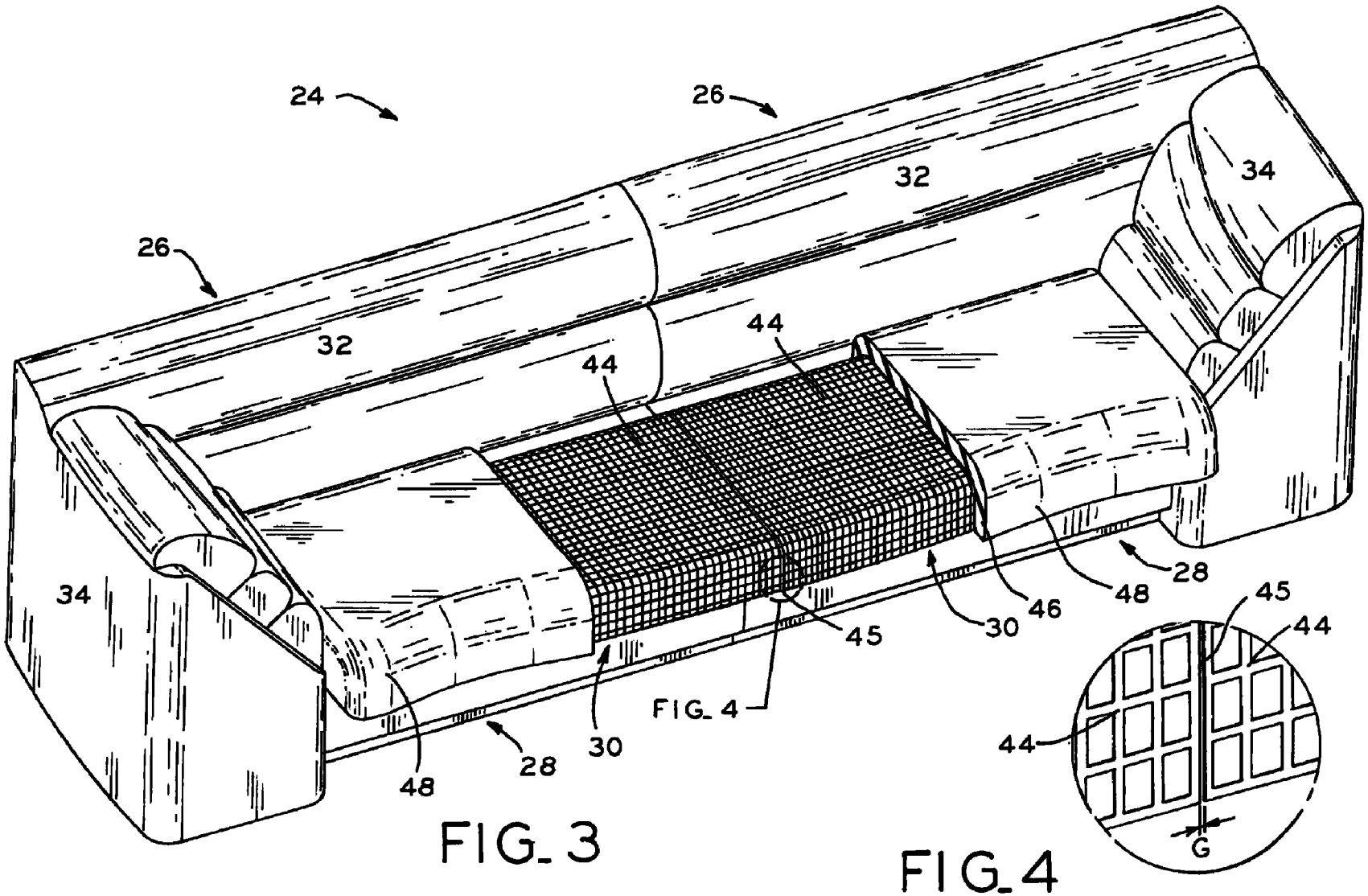
FIG. 3 is a partially segmented cross sectional view of the assembled seat of FIG. 2, depicting the support material extending substantially entirely to the junction.
FIG. 4 is an enlarged, fragmentary view of FIG. 3.

As shown in FIG. 3, and discussed in detail above with reference to FIGS. 1 and 2, modular seating components 26 are arranged in adjacent, opposing relationship to form modular seat 24. In this position, the substantially planar unsupported surfaces formed by support material 44 and extending between front walls 36 and back walls 38 are adjacent to and aligned with one another. Specifically, as shown in FIG. 4, support material 44 of the individual, modular seating components 26 lie on substantially the same plane and are separated only by a small gap G. In another exemplary embodiment, support material 44 of the individual, modular seating components 26 is in direct contact across junction 45 and gap G is eliminated.

Referring to FIG. 2, front wall 36 and back wall 38 each have a length $L_w$, which is substantially equal for both front wall 36 and back wall 38. Thus, the substantially planar unsupported surface formed by support material 44 extends substantially entirely along length $L_w$ of front wall 36 and back wall 38. In another exemplary embodiment, the length of front wall 36 and back wall 38 are not substantially equal, e.g., when seating frames 30 of individual modular seating components 26 having corresponding chamfers to form an L-shaped modular seat 24. However, even in this embodiment, the substantially planar unsupported surface formed by support material 44 extends substantially entirely along the lengths of both walls 36, 38 and along all points therebetween.

Figure 5:
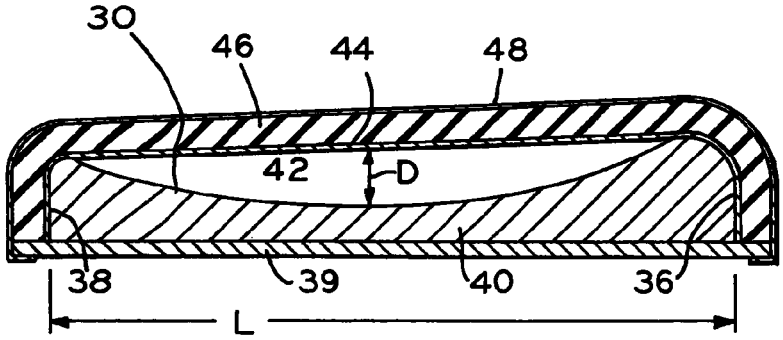
FIG. 5 is a cross-sectional view substantially similar to the cross sectional view of FIG. 7 depicting a seating frame and related components according to one exemplary embodiment.

Referring to FIG. 5, depression 42 formed by connecting structure 40 extends along length L substantially entirely from front wall 36 to back wall 38. Additionally, connecting structure 40 is spaced apart from support material 44 by distance D. While distance D is described below and depicted herein as varying along length L, distance D may also be consistent along length L, such that connecting structure 40 has a planar upper surface forming depression 42. Due to the formation of depression 42 by connecting structure 40, the ridge formed at the junction between the modular seating components of the prior art is eliminated and all of the support at the junction of the two seating units 30 is provided by the tightly stretched fabric sheets 44. Advantageously, eliminating the ridge formed at junction 45 between modular seating components 26 when modular seating components 26 are in adjacent, opposing relationship removes any appreciable difference between the support provided to a person seated on or near junction 45 and a person seated at a location away from junction 45.

Thus, the extension of support material 44 into depression 42 of connecting structure 40 does not result in support material 44 contacting connecting structure 40. Furthermore, because of the slightly resilient support provided by the stretched fabric 44, thinner foam 46 can be used. As a result, cushioning material 46 and covering 48 are substantially prevented from tightening around a person seated on support material 44 as the same are extended. Such tightening of cushioning material 46 and covering 48 may cause a user seated thereon to experience a mild pinching sensation, which is substantially eliminated by the use of resiliently extensible support material 44 and connecting structure 40.

As shown in FIGS. 2 and 5, the portion of seating frame 30 including front wall 36, back wall 38, and connecting structure 40, may be formed as an integral, monolithic component. In another exemplary embodiment, shown in FIGS. 6 and 7, front walls 36', 36", back walls 38', 38", and connecting structures 40', 40" of seating frames 30', 30", are formed as separate, individual components. Referring to FIG. 6, connecting member 40' is secured to front wall 36' and back wall 38' via any known securement mechanism, such as fasteners or adhesives. In one exemplary embodiment, connecting member 40' is connected to front wall 36' and back wall 38' via screws 41. As shown in FIG. 6, cavity 50 is formed between connecting structure 40' and support 39 of seating frame 30'. By forming cavity 50, less material is used in the construction of seating frame 30', which, correspondingly, reduces manufacturing and material costs. Alternatively, in another exemplary embodiment, connecting member 40' is comprised of a plurality of distinct components, each extending from first wall 36' to back wall 38'.

The embodiment of seating frame 30 is depicted in FIG. 7 as seating frame 30". Seating frame 30" of FIG. 7 has several components which are identical or substantially identical to corresponding components of seating frame 30 of FIG. 5 and identical reference numerals are used to indicate identical or substantially identical components therebetween. Seating frame 30" includes front wall 36", back wall 38", and connecting structure 40". Connecting structure 40" is formed as a pair of individual, distinct ribs or end panels 90 extending between front wall 36" and back wall 38" at respective ends of unit 26 and connected to support 39. In one exemplary embodiment, a plurality of ribs 90 extend along length $L_w$ (FIG. 2) between front wall 36" and back wall 38" and are separated by predetermined distances to cooperatively form connecting structure 40". Advantageously, by forming connecting structure 40 as a plurality of ribs, the cost of the material required to form connecting structure 40 is substantially reduced, while still maintaining sufficient strength. The use of ribs 90 to form connecting structure 40" creates cavity 92 substantially adjacent rib 90 and between front wall 36" and back wall 38". Cavity 92 provides a large volume into which support material 44 may extend when a person sits on the seat.

Figure 8:
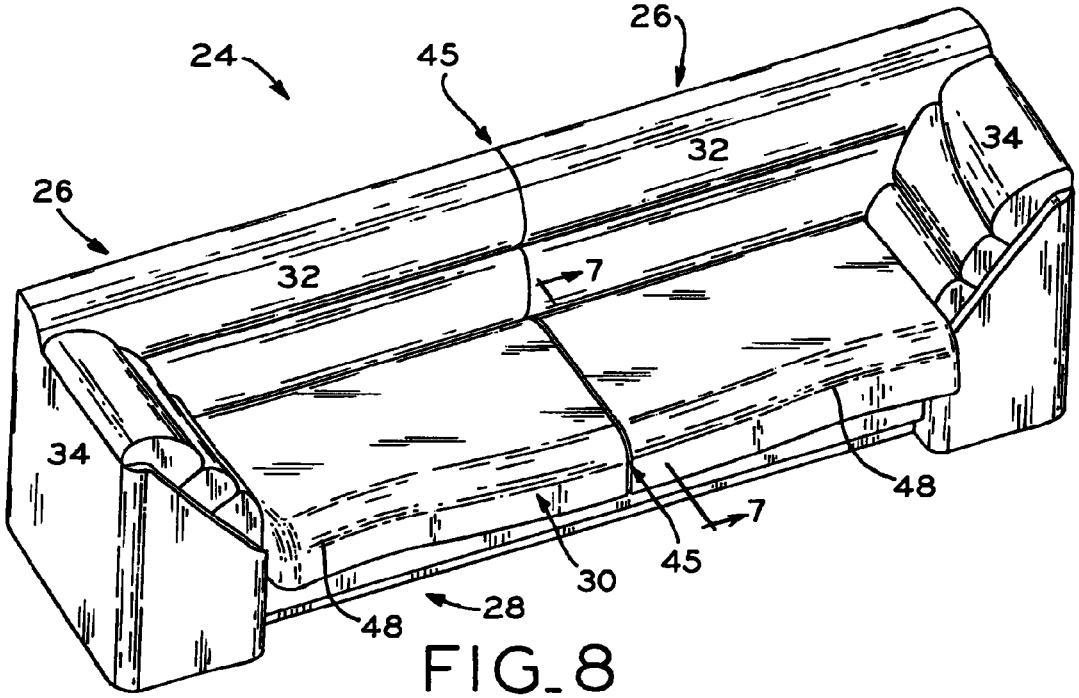
FIG. 8 is a perspective view of the assembled modular seat of FIG. 1.
Figure 9:
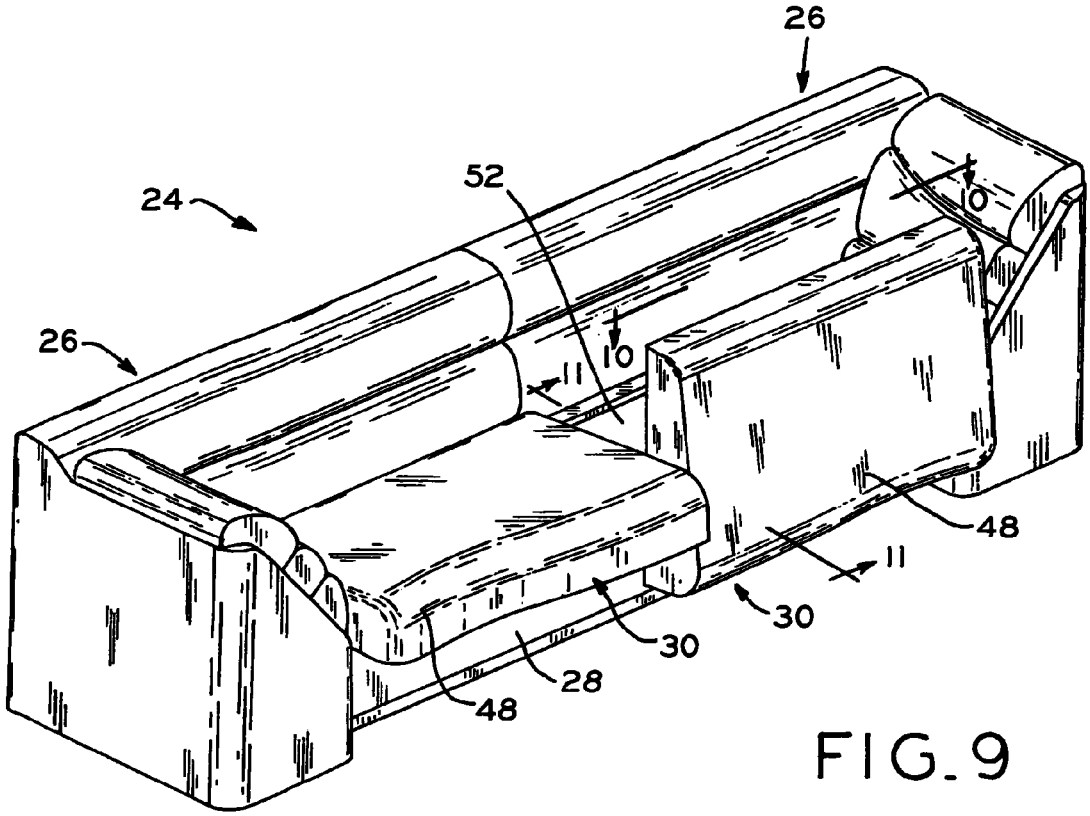
FIG. 9 is a perspective view of the assembled modular seat of FIG. 1 depicting the seating frame of one of the modular seating components in an actuated position.

Referring to FIG. 8, both individual, modular seating components 26 forming modular seat 24 are depicted with their corresponding seating frames 30 (FIG. 2) in the seating position, i.e., are positioned to receive and support a user thereon. In contrast, as shown in FIG. 9, one of seating frames 30 is rotated to a position substantially perpendicular to the other of seating frames 30. In this position, access to storage area 52, formed as a cavity within base 28, is provided. Storage area 52 is used to store life jackets, skis, or other marine items, for example, therein.

Figure 10:
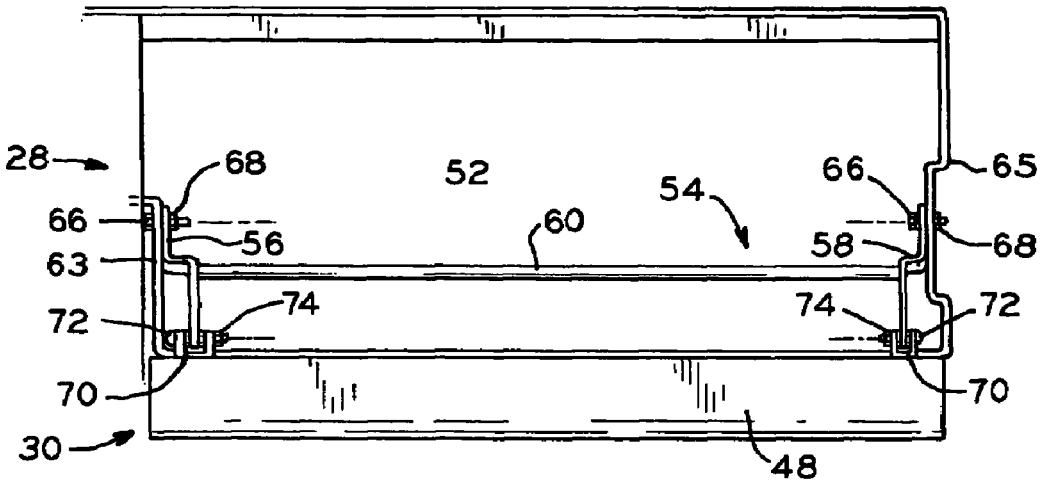
FIG. 10 is a fragmentary plan view of the assembled seat of FIG. 9 taken along line 10-10 of FIG. 9.
Figure 11:
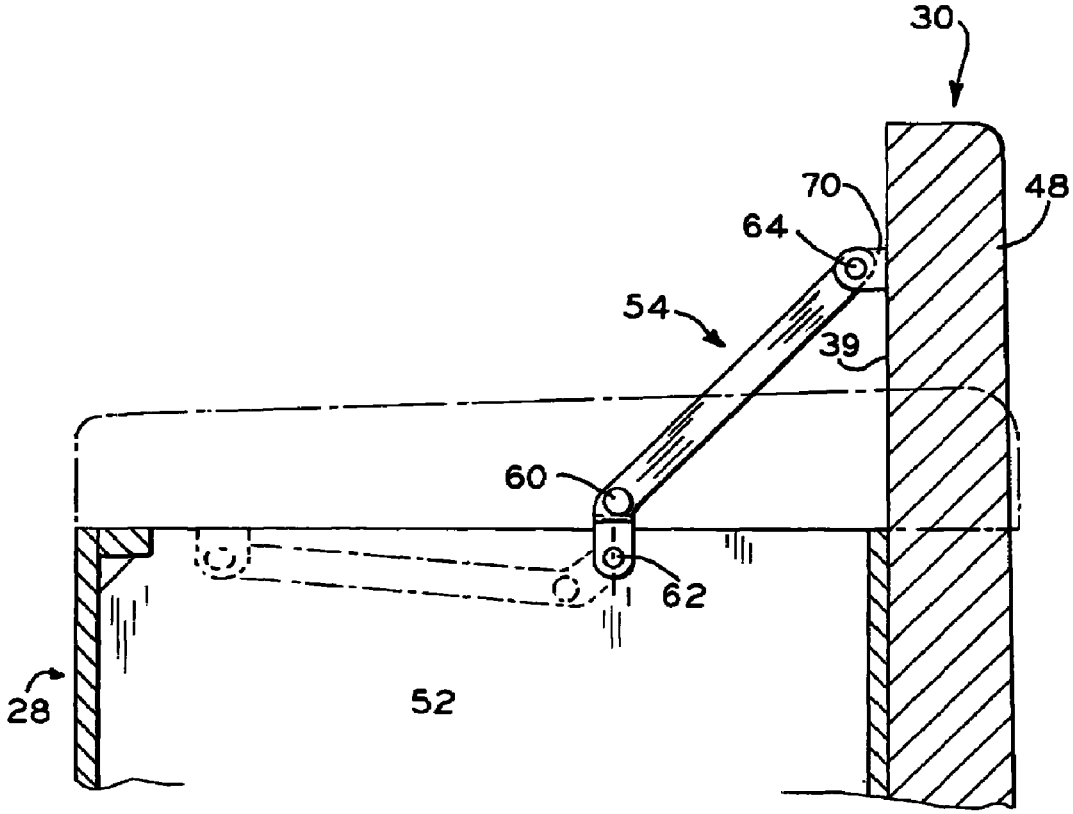
FIG. 11 is a fragmentary cross sectional view of the assembled seat of FIG. 9 taken along line 11-11 of FIG. 9.

With reference to FIGS. 10 and 11, actuation mechanism 54, which connects base 28 (FIG. 2) to seating frame 30, is shown. Referring to FIG. 10, actuation mechanism 54 includes linkages 56, 58 positioned on opposing sides of connecting rod 60. Connecting rod 60 helps to ensure that movement of one of linkages 56, 58 results in corresponding movement of the other of linkages 56, 58. Apertures 62, 64 (FIG. 11) extend through opposing ends of linkages 56, 58. Linkages 56, 58 are connected to opposing side walls 63, 65 of base 28 by bolts 66 extending through apertures 62. Bolts 66 are then retained in place by nuts 68. Linkages 56, 58 are not rigidly secured to base 28, but are free to pivot about bolts 66. Thus, bolts 66 and nuts 68, in combination with apertures 62 of linkages 56, 58, form a first rotational point for linkages 56, 58.

At the opposing side of linkages 56, 58, apertures 64 are aligned with corresponding apertures extending through brackets 70 (FIG. 10) secured to seating frame 30. Brackets 70 may be secured to seating frame 30 in any known manner, such as by fasteners. With the apertures of brackets 70 and apertures 64 of linkages 56, 58 aligned, bolts 72 are passed therethrough and secured via nuts 74. Due to the design of brackets 70, bolts 72 and nuts 74 may be securely fastened thereto to create a second rotational point for linkages 56, 58 about bolts 72. While linkages 56, 58 are depicted and described herein as secured to base 28 and seating frame 30 via bolts 56, 72, nuts 68, 74, and brackets 70, linkages 56, 58 may be secured in any known manner capable of providing a point of rotation for each of linkages 56, 58.

As shown in FIG. 11, movement of seating frame 30 from a first position, shown in dashed lines, to a second position, shown in solid lines, is facilitated by actuation mechanism 54. Specifically, to move seating frame 30 from the first position substantially covering storage area 52 to the second position substantially exposing storage area 52, seating frame 30 is pivoted about the first rotational point formed by bolts 66 to raise seating frame 30 from base 28. Correspondingly, seating frame 30 is rotated about the second rotational point formed by bolts 72 and brackets 70 to rotate seating frame 30 from the first position substantially parallel to base 28 to the second position substantially perpendicular to base 28. In this position, storage area 52 of base 28 is exposed, such that a person may access storage area 52 to position items therein or remove items therefrom.

To move seating frame 30 from the second position to the first position, substantially parallel to base 28, seating frame 30 is lifted causing seating frame 30 to pivot about the second rotation point formed by nuts 74 and brackets 70. Actuation mechanism 54 may then be rotated about the first rotation point formed by bolts 66 to cause linkages 56, 58 to rotate downward into storage area 52 of base 28. As seating frame 30 is moved toward base 28, actuation mechanism 54 rotates into the position shown in dashed lines in FIG. 11 and seating frame 30 is positioned upon and substantially parallel to base 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular seat comprising:

a plurality of modular seating components each including a seating frame having a front support structure, a back support structure, and a connecting structure extending therebetween, said connecting structure forming a depression extending substantially entirely from said front support structure to said back support structure, said plurality of modular seating components each further including a sheet of stretched resiliently extensible fabric support material secured to and extending substantially entirely from said front support structure of said seating frame to said back support structure of said seating frame, said support material extending across the depression of said connecting structure to form a substantially planar surface spaced apart from said connecting structure, one of said plurality of modular seating components positioned next to another of said plurality of modular seating components in adjacent side-by-side opposing relationship to form a junction therebetween, said substantially planar surface of said support material of said one of said plurality of modular seating components is directly adjacent to and aligned with said substantially planar surface of said support material of said another one of said plurality of modular seating components at said junction, said sheets of stretched support material being substantially unsupported from below along the junction of adjacent modular seating components.

2. The modular seat of claim 1, wherein said front support structure, said back support structure, and said connecting structure comprise an integral, monolithic component.

3. The modular seat of claim 1, wherein said connecting structure comprises a plurality of individual ribs.

4. The modular seat of claim 1, wherein each of said plurality of modular seating components further comprises a base having a storage area formed therein, said seating frame positioned atop said base.

5. The modular seat of claim 4, wherein at least one of said plurality of modular seating components further comprises an actuation mechanism having a linkage pivotally connected to at least one of said base and said seating frame, whereby said seating frame is actuatable from a first position substantially covering said storage area to a second position substantially exposing said storage area via said linkage.

6. The modular seat of claim 1, further comprising cushioning material positioned atop said support material and a covering at least partially enclosing said cushioning material.

7. The modular seat of claim 1, wherein said support material comprises a polymer.

8. The modular seat of claim 7, wherein said support material is polyester.

9. A boat comprising:

a deck;

a plurality of modular seating components positioned on said deck, each said modular seating component including a base and a seating frame positioned on said base, said seating frame including a front support structure having a first length, a back support structure having a second length, and a connecting structure extending between said front support structure and said back support structure, said connecting structure forming a depression extending substantially entirely between said front support structure and said back support structure, each said modular seating component further including a sheet of stretched resiliently extensible fabric support material secured to said front support structure and said back support structure, said support material extending across said depression to form a substantially planar surface spaced apart from said connecting structure and extending substantially entirely from said front support structure along said first length to said back support structure along said second length, two of said modular seating components being mounted on said deck in adjacent side-by-side opposing relationship to form a junction therebetween, respective said sheets of fabric support material being co-planar and closely spaced to form a small gap therebetween, said sheets of stretched support material being substantially unsupported from below along the junction of adjacent modular seating components.

10. The boat of claim 9, wherein said connecting structure comprises a plurality of individual ribs.

11. The boat of claim 9, wherein said support material further comprises a polymer.

12. The boat of claim 11, wherein said support material is polyester.

13. The boat of claim 9, wherein said modular seat further comprises cushioning material positioned upon said support material and a covering positioned over said cushioning material.

14. The boat of claim 9, wherein said base of said modular seating component further comprises a storage area and actuation means for moving said seating frame to access said storage area.

15. The boat of claim 9, wherein said base of said modular seating component further comprises a storage area and an actuation mechanism, said actuation mechanism having a linkage pivotally connected to at least one of said base and said seating frame, whereby said seating frame is actuatable from a first position substantially covering said storage area to a second position substantially exposing said storage area.

16. A modular seat comprising:

a plurality of modular seating components each including a seating frame having a front support structure, a back support structure, and a connecting structure extending therebetween, said plurality of modular seating components each further including a sheet of stretched resiliently extensible fabric support material secured to and extending substantially entirely from said front support structure of said seating frame to said back support structure of said seating frame to form a substantially planar surface, one of said plurality of modular seating components positioned next to another of said plurality of modular seating components in adjacent side-by-side opposing relationship to form a junction therebetween, said substantially planar surface of said support material of said one of said plurality of modular seating components is directly adjacent to and aligned with said substantially planar surface of said support material of said another one of said plurality of modular seating components at said junction , said sheets of stretched support material being substantially unsupported from below along the junction of adjacent modular seating components.

17. The modular seat of claim 16, further comprising cushioning material positioned atop said support material and a covering at least partially enclosing said cushioning material.

18. A boat comprising:

a deck;

a plurality of modular seating components positioned on said deck, each said modular seating component including a base and a seating frame positioned on said base, said seating frame including a front support structure having a first length, a back support structure having a second length, and a connecting structure extending between said front support structure and said back support structure, each said modular seating component further including a stretched resiliently extensible fabric support material secured to said front support structure and said back support structure to form a substantially planar surface extending substantially entirely from said front support structure along said first length to said back support structure along said second length, two of said modular seating components being mounted on said deck in adjacent side-by-side opposing relationship to form a junction therebetween, respective said sheets of fabric support material being co-planar and closely spaced to form a small gap therebetween, said sheets of stretched support material being substantially unsupported from below along the junction of adjacent modular seating components.

19. The boat of claim 18, wherein said modular seat further comprises cushioning material positioned upon said support material and a covering positioned over said cushioning material.

* * * * *